US008959777B2

(12) United States Patent
Forman et al.

(10) Patent No.: US 8,959,777 B2
(45) Date of Patent: Feb. 24, 2015

(54) SHEARING APPARATUS

(75) Inventors: Scott A. Forman, Albuquerque, NM (US); Robert J. Winters, Albuquerque, NM (US)

(73) Assignee: EMVolution, Inc., Albuquerque, NM (US)

( * ) Notice: Subject to any disclaimer, the term of this patent is extended or adjusted under 35 U.S.C. 154(b) by 67 days.

(21) Appl. No.: 13/312,873

(22) Filed: Dec. 6, 2011

(65) Prior Publication Data

US 2012/0137526 A1 Jun. 7, 2012

Related U.S. Application Data

(60) Provisional application No. 61/420,254, filed on Dec. 6, 2010, provisional application No. 61/506,762, filed on Jul. 12, 2011.

(51) Int. Cl.
*B26B 13/22* (2006.01)
*B26B 13/06* (2006.01)
*B26B 13/12* (2006.01)

(52) U.S. Cl.
CPC ..... *B26B 13/06* (2013.01); *B26B 13/12* (2013.01); *B26B 13/22* (2013.01)
USPC ..... 30/146

(58) Field of Classification Search
CPC ..... B26B 13/06; B26B 13/12; B26B 13/22; B26B 13/08
USPC ..... 30/146, 134, 254, 123, 135, 124, 186, 30/112, 195, 233; 7/144, 158; 606/174, 606/138, 167
See application file for complete search history.

(56) References Cited

U.S. PATENT DOCUMENTS

| | | | | | |
|---|---|---|---|---|---|
| 404,169 | A * | 5/1889 | Clark | 30/146 |
| 580,995 | A * | 4/1897 | Thorlakson | 30/146 |
| 1,363,600 | A * | 12/1920 | Johnson | 30/146 |
| 2,619,965 | A * | 12/1952 | Goldstone | 606/118 |
| 2,865,099 | A * | 12/1958 | Blackwood | 606/138 |
| 4,753,009 | A * | 6/1988 | Haga | 30/123 |
| 2009/0000127 | A1 * | 1/2009 | Smith | 30/134 |

* cited by examiner

*Primary Examiner* — Ghassem Alie
(74) *Attorney, Agent, or Firm* — Jennifer S. Stachniak; Robert W. Becker

(57) ABSTRACT

A shearing apparatus comprising an index portion, a thumb portion, and a ripping portion. The index portion has an index blade arcuately movable in a first direction defining an arc about a pivot. The thumb portion is pivotably connected to the index portion at the pivot, and has a thumb blade arcuately movable in a second direction that is substantially opposite the arc of the first direction. The ripping portion is disposed on the thumb blade or the index blade, and has a ripping blade manually movable in a third direction at an angle, parallel or perpendicular to a line parallel to at least one of the index blade and the thumb blade.

14 Claims, 9 Drawing Sheets

SHEARING APPARATUS

The present application should be granted the priority dates of Dec. 6, 2010, the filing date of the corresponding provisional application U.S. App. Ser. No. 61/420,254, and Jul. 12, 2011, the filing date of a further corresponding provisional application U.S. App. Ser. No. 61/506,762.

BACKGROUND AND SUMMARY

The present invention relates generally to a shearing apparatus and more specifically to apparatuses, devices and systems configured for bi-directional shearing in an emergency medicine or wilderness medicine environment.

A first preferred embodiment of a shearing apparatus includes an index portion having an index blade arcuately movable in a first direction defining an arc about a pivot; a thumb portion connected to the index portion at the pivot, the thumb portion including a thumb blade arcuately movable in a second direction, wherein the second direction is substantially opposite the arc of the first direction; and a ripping portion including a ripping blade manually movable in a third direction substantially acute to a line parallel to at least one of the index blade or the thumb blade.

A second preferred embodiment of a shearing apparatus includes an index portion having an index blade arcuately movable in a first direction defining an arc about a pivot; a thumb portion connected to the index portion at the pivot, the thumb portion having a thumb blade arcuately movable in a second direction, wherein the second direction is substantially opposite the arc of the first direction; and a ripping portion integral with the thumb portion, the ripping portion including a ripping blade manually movable in a third direction substantially acute to a line parallel to the thumb blade.

A third preferred embodiment of a shearing apparatus includes an index portion including an index blade arcuately movable in a first direction defining an arc about a pivot; an index bow defining a first opening adapted to receive an index finger, a second opening adapted to receive one or more non-index fingers, and a carabiner latch configured for selective opening of the index bow; and a thumb portion connected to the index portion at the pivot, the thumb portion including a thumb blade arcuately movable in a second direction, wherein the second direction is substantially opposite the arc of the first direction; and a pin selectively engageable with a detent configured to substantially prohibit arcuate movement of the index blade and the thumb blade.

A fourth preferred embodiment of a shearing apparatus includes an index portion having an index blade arcuately movable in a first direction defining an arc about a pivot; a thumb portion pivotably connected to the index portion at the pivot, the thumb portion having a thumb blade arcuately movable in a second direction, wherein the second direction is substantially opposite the ark of the first direction; and a ripping portion disposed on one of the thumb blade or the index blade and having a ripping blade manually movable in a third direction at an angle, parallel or perpendicular to a line parallel to at least one of the index blade and the thumb blade.

Other aspects and features of the present invention are described in detail with reference to the following schematic drawings.

DETAILED DESCRIPTION OF THE PREFERRED EMBODIMENTS

Figure 1:
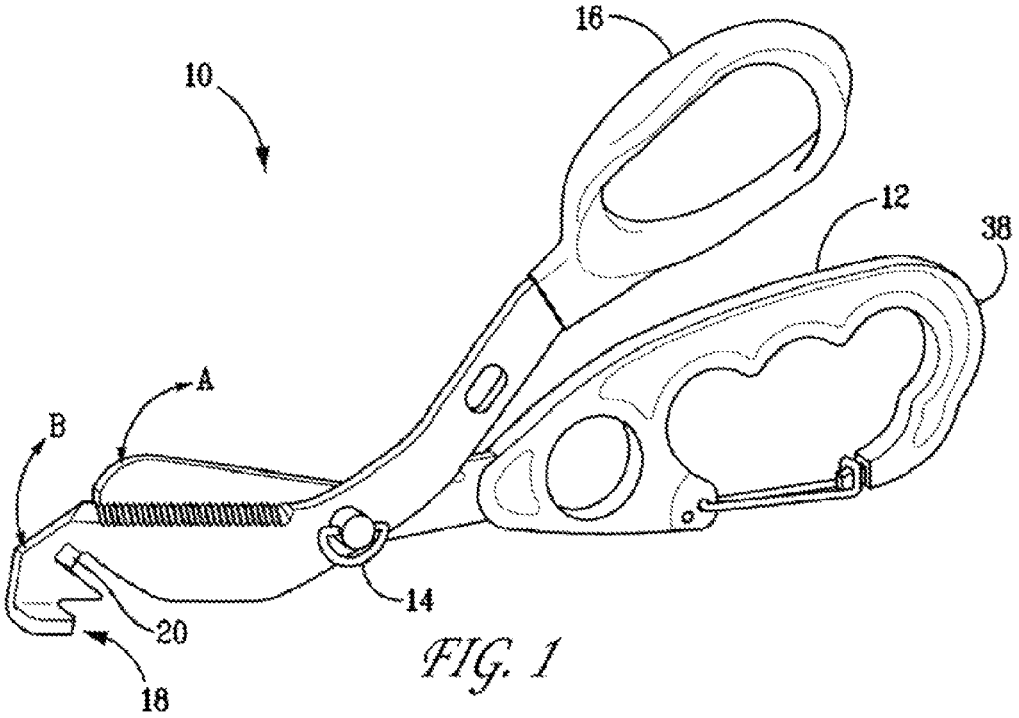
FIG. 1 is a first perspective view of a shearing apparatus in accordance with one or more preferred embodiments of the present invention.
Figure 2:
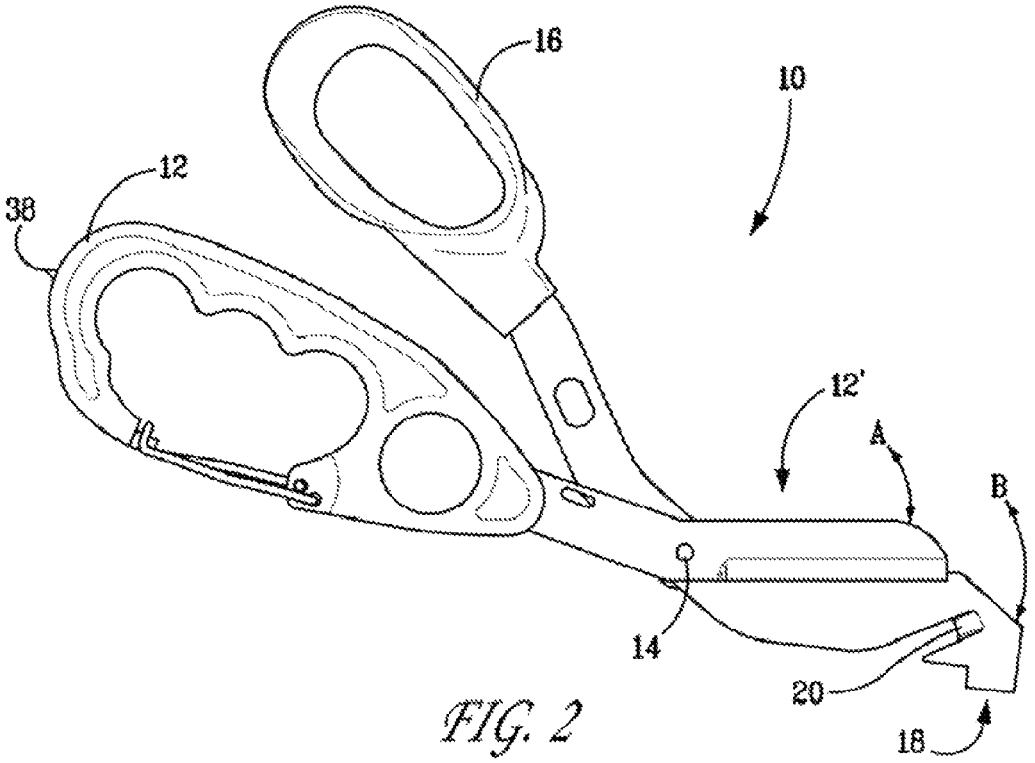
FIG. 2 is a second perspective view of a shearing apparatus in accordance with one or more preferred embodiments of the present invention.

As will be appreciated by one skilled in the art, aspects of the present invention may be embodied as an apparatus, system, or device and are usable in emergency medicine, wilderness medicine, adventure sports, military and/or law enforcement operating environments.

1. Preferred Embodiments

As shown in the FIGURES, a shearing apparatus 10 according to a first preferred embodiment can include an index portion 12 having, including and/or defining an index blade, which is indicated generally by the reference numeral 12', and which is arcuately movable in a first direction (along arrow A) defining an arc about a pivot 14. The index portion 12 of the apparatus 10 of the first preferred embodiment can function to interface with one or more non-thumb fingers of a user and permit the user to cut, shear, scrape and/or shred an article using the index blade. The index blade 12' of the index portion 12 can be straight (as shown), serrated, linear, curved, or any suitable combination thereof for permitting efficient shearing of the article. In particular, the index portion 12 can have an index blade suited for shearing through or partially through fabrics, textiles, sheet metals, composites, organic materials, threads, ropes, clothing and the like.

The apparatus 10 of the first preferred embodiment can also include a thumb portion 16 connected to the index portion 12 at the pivot 14. The thumb portion 16 can have, include or define a thumb blade, which is indicated generally by the reference numeral 16', and which is arcuately movable in a second direction (along arrow B). As shown in the FIGURES, the second direction can be substantially opposite the arc of the first direction, such that during use the thumb portion 16 and index portion 12 move along the arcs A and B in opposing directions.

The thumb portion 16 of the apparatus 10 of the first preferred embodiment can function to interface with a thumb of a user and permit the user to cut, shear, scrape and/or shred an article using the thumb blade. The thumb blade 16' of the thumb portion 16 can be serrated (as shown), straight, linear, curved, or any suitable combination thereof for permitting efficient shearing of the article. In particular, the thumb portion 16 can have a thumb blade suited for shearing through or partially through fabrics, textiles, sheet metals, composites, organic materials, threads, ropes, clothing and the like.

Figure 5:
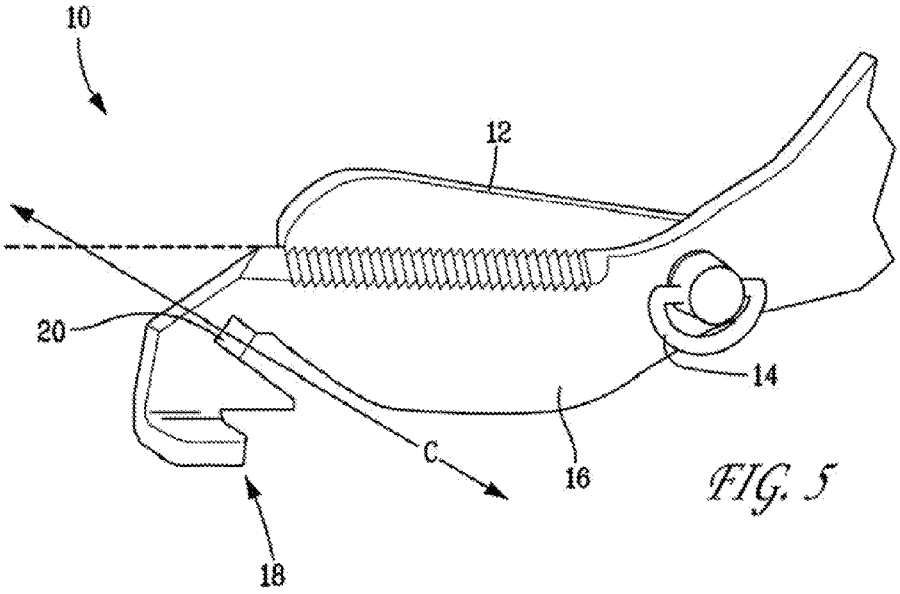
FIG. 5 is a perspective view of a second portion of a shearing apparatus in accordance with one or more preferred embodiments of the present invention.
Figure 6:
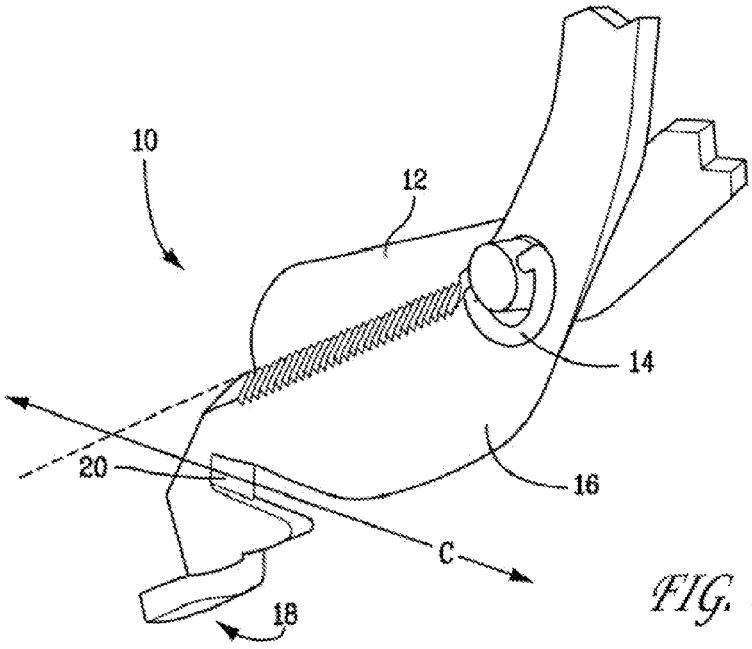
FIG. 6 is a perspective view of a third portion of a shearing apparatus in accordance with one or more preferred embodiments of the present invention.

The apparatus 10 of the first preferred embodiment can also include a ripping portion 18 having, including and/or defining a ripping blade 20 manually movable (i.e. via a pulling action carried out on the shearing apparatus by the user) in a third direction (along arrow C) substantially acute to a line parallel to at least one of the index blade and the thumb blade (see FIGS. 5 and 6). In one variation of the apparatus 10 of the first preferred embodiment, the ripping portion 18 can include a tab portion 17 as shown in the FIGURES. The tab portion 17 can be oriented in a substantially perpendicular direction relative to arrows A, B, and C, such that the tab portion is perpendicular to any and/or all cutting directions of the apparatus 10 of the preferred embodiment. The tab portion can function to prevent the apparatus 10 of the first preferred embodiment from dipping or diving into a patient's tissue during shearing and/or removal of the patient's clothing. As shown in FIGS. 5 and 6, the ripping blade 20 is movable along direction C, the defining arrow of which intersects the line L along the index/thumb blades shown in phantom at an acute angle. As used herein, the term acute angle can include any angle greater than zero degrees (i.e., substantially parallel to the line parallel to the index blade and/or thumb blade) and less than ninety degrees (i.e., substantially perpendicular to the line parallel to the index blade and/or thumb blade). In alternatives of the apparatus 10 of the first preferred embodiment, the acute angle can be approximately between twenty-five and forty-five degrees, or approximately thirty degrees. In another alternative of the apparatus 10 of the first preferred embodiment, the acute angle can be a function of the rigidity and/or material selection of the thumb portion 16 and/or the ripping portion 18. Alternatively, the acute angle can be approximately an angle optimized for user leverage in pulling and/or ripping with the ripping blade 20.

The ripping portion 18 functions to interface with the index portion 12 and the thumb portion 16 and provide additional leverage to permit the user to rip, cut, shear, scrape and/or shred an article by pulling the apparatus 10. The ripping blade 20 can be straight (as shown), serrated, linear, curved, or any suitable combination thereof for permitting efficient ripping of the article. In particular, the ripping blade 20 can be suited for shearing through or partially through fabrics, textiles, sheet metals, composites, organic materials, threads, ropes, clothing and the like. The orientation of the ripping blade 20 can be fixed such that the direction C and the acute angle are fixed or permanent. Alternatively, the orientation of the ripping blade 20 can be variable such that the direction C and the acute angle can be changed and/or altered according to one or more predetermined parameters, including user choice, material to be ripped, ambient temperature of the material, disposition or orientation of the material relative to the user and/or any other suitable parameter or condition.

In a first variation of the apparatus 10 of the first preferred embodiment, the ripping portion 18 can be connected to the thumb portion 16. As shown in the FIGURES, the ripping portion 18 can be disposed and/or connected to the thumb portion 16 at or adjacent to the thumb blade 16' of the thumb portion; or at a distal end relative to a thumbhole portion or thumb bow 30 of the thumb portion 16 into which a user can insert his or her thumb. Alternatively, the ripping portion 18 can be disposed and/or connected to the thumb portion 16 adjacent and opposite the thumb blade 16' of the thumb portion at a distal end from the thumb bow 30 (see e.g. FIG. 7). In yet another alternative, the ripping portion 18 can be integral or monolithic with the thumb portion 16, for example constructed or cast out of the same material, so as to increase the rigidity durability and dependability of the apparatus 10 of the first variation of the first preferred embodiment.

In a second variation of the apparatus 10 of the first preferred embodiment, the index portion 12 can include an index bow defining a first opening 22 adapted to receive an index finger, and a second opening 24 adapted to receive one or more non-index fingers. Separation of the first opening 22 from the second opening 24 can allow for greater cutting leverage and ergonomics. Furthermore, separation of the first and second openings 22, 24 can lessen the volume of the second opening 24, which can also function to secure the apparatus 10 of the first preferred embodiment to a belt or similar feature of a user in combination with a gate and/or as a carabiner as described herein.

As shown in the FIGURES, the apparatus 10 of the second variation of the first preferred embodiment can include a gate 26 that functions in cooperation with the second opening 24 to operate as a carabiner or selectively openable connector, permitting the apparatus 10 of the second variation of the first preferred embodiment to be securely and selectively fastened to a user's clothing, belt, medical bag, strap, backpack and the like. In an alternative of the apparatus 10 of the first preferred embodiment, the gate 26 can include a spring 28 so as to spring load and/or bias the gate 26 to remain in a closed position, as shown in the FIGURES, thus preventing unintended opening of the gate 26 and preventing loss or damage of the apparatus 10. In other alternatives of the apparatus 10 of the second variation of the first preferred embodiment, the gate 26 can be a wire gate, a straight gate, or a bent gate. In still other alternatives of the apparatus 10 of the second variation of the first preferred embodiment, the gate 26 can be lockable in at least one of an open or closed position, and can include a twist lock or a screw lock, which can be either automatically or manually locking depending upon the configuration thereof.

In a third variation of the apparatus 10 of the first preferred embodiment, the pivot 14 can include an adjustable connector configured to permit adjustment of a tension between the index portion 12 and the thumb portion 16. The pivot 14 functions to allow a user to maximize blade articulation and cutting precision, and can also allow a user to interchange one or more index portions 12 with one or more thumb portions 16. As shown in the FIGURES, the pivot 14 can include a spring closure having a spring washer (not shown) and a D-ring, which permits a user to maintain optimal tension and friction between the index portion 12 and the thumb portion 16 for added blade articulation and cutting precision.

The index portion 12, thumb portion 16 and ripping portion 18 of the variations of the apparatus 10 of the first preferred embodiments can be constructed of any number of durable materials or a suitable combination thereof, including for example titanium, titanium alloys, stainless steel, ceramic, carbon fiber and/or polymer composites. In one alternative, the index portion 12, thumb portion 16 and ripping portion 18 can be constructed of 6Al/4V titanium alloy, which is corrosion-resistant and lightweight. In another alternative of the apparatus 10 of the first preferred embodiment, the index portion 12, thumb portion 16 and ripping portion 18 can be composed of an injected molded plastic or other polymer, and the blade portions thereof (described herein) can be composed of a hard metal material, such as stainless steel, titanium or titanium alloy. In another alternative of the apparatus 10 of the first preferred embodiment, the index portion 12, thumb portion 16 and ripping portion 18 can be selectively connected through the pivot 14, which can include a spring closure having a spring washer (as described above) and a D-ring, which permits a user to selectively interchange different index portions 12 and thumb portions 16 and therefore different material types, blade shapes, blade sizes, blade angles, ripping blade sizes, ripping blade angles, ripping blade materials, and the like.

In a fourth variation of the apparatus 10 of the first preferred embodiment, the apparatus 10 can include an oxygen key or wrench 32. The oxygen key 32 can function to adjust a flow from an oxygen bottle to a patient. As shown in the FIGURES, in one alternative of the fourth variation of the apparatus 10—*of the first preferred embodiment, the oxygen key 32 can include and/or be defined by an opening within the thumb portion 16 of the apparatus 10. Alternatively, the oxygen key 32 can include and/or be defined by an opening within the index portion 12 of the apparatus 10. In another alternative of the fourth variation of the apparatus 10 of the first preferred embodiment, the oxygen key 32 can include and/or be defined by an opening within one or both of the index portion 12 and the thumb portion 16. In addition, a ratchet-type mechanism can be disposed in the oxygen key or wrench 32.

In a fifth variation of the apparatus 10 of the first preferred embodiment, the apparatus 10 can include a glass breaker 38. In one alternative of the fifth variation of the apparatus 10 of the first preferred embodiment, the glass breaker 38 can be a projection formed integral with or connected to the index portion 12. The glass breaker 38 can function to break various types of glass found in an emergency situation, such as automotive window or windshield glass. In another alternative of the apparatus 10 of the fifth variation of the first preferred embodiment, the glass breaker 38 can be affixed to the index portion 12 of the apparatus 10, and the glass breaker 38 can be composed of a distinct and harder material than that of the index portion 12. As an example, the glass breaker 38 can be composed of hardened carbide steel, whereas the index portion 12 can be composed of a more lightweight titanium, titanium alloy or stainless steel. The glass breaker 38 can also be varied in size and/or shape, can be spring-loaded, and can be exchanged with other glass breakers (not shown) of differing density, hardness, material, size and shape by a user depending upon the type of his or her practice.

In a sixth variation of the apparatus 10 of the first preferred embodiment, the apparatus 10 can include a locking mechanism 34, 36 selectively prohibiting arcuate movement of the index portion 12 and the thumb portion 16. In the sixth variation of the apparatus 10 of the first preferred embodiment, the index portion 12 and the thumb portion 16 are adapted to lock together in a closed position to prevent inadvertent opening of the apparatus 10 during storage or transport.

Figure 3:
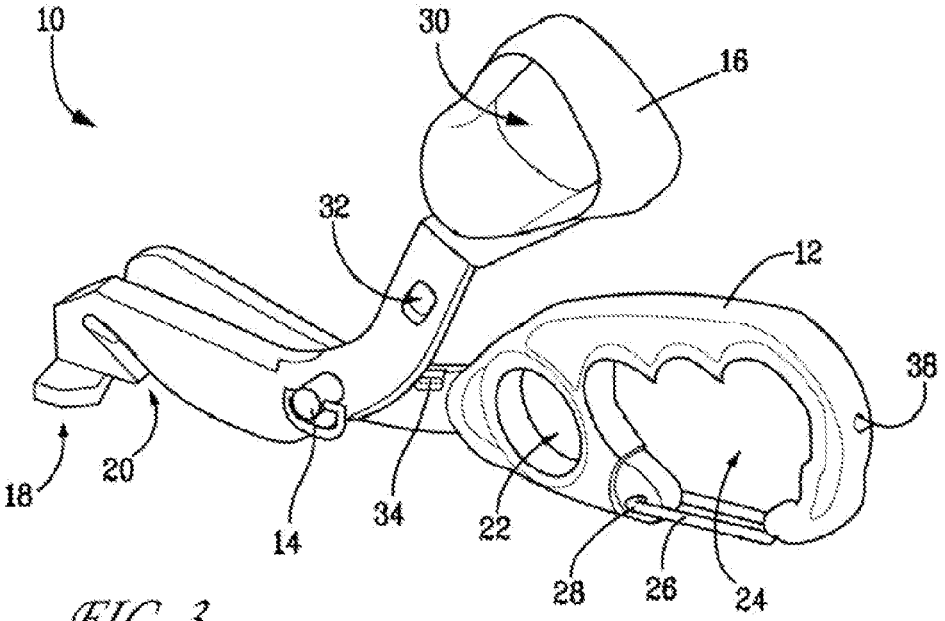
FIG. 3 is a third perspective view of a shearing apparatus in accordance with one or more preferred embodiments of the present invention.

As an example of the configuration of the apparatus 10 of the first preferred embodiment, the thumb portion 16 can include a pin 36 (shown in FIG. 4) or protrusion that is adapted to selectively mate with a detent or recess 34 (shown in FIGS. 3 and 4) disposed in the index portion 12. The pin 36 and detent 34 can be configured such that a user can selectively engage the pair by a slight lateral movement of the index portion 12 relative to the thumb portion 16. Furthermore, the pin 36 can be positioned on the thumb portion 16 such that during operation, it abuts against a top surface of the index portion 12 to prevent over-shearing of the apparatus 10 while still maintaining proper articulation and a full range of cutting motion. Conversely, the pin 36 can be disposed on the index portion 12 and the detent 34 can be disposed in/on the thumb portion 16. Other suitable locking mechanisms or means, such as selectively positionable hook-and-eye mechanisms, selectively positionable magnetic elements, a spring biased in a closing position, and the like can be employed as an alternative to or in addition to the pin 36 and detent 34 described herein.

As shown in the FIGURES, an apparatus 10 according to a second preferred embodiment can include an index portion 12 having an index blade 12' arcuately movable in a first direction (along arrow A) defining an arc about a pivot 14. The index portion 12 of the apparatus 10 of the second preferred embodiment can function to interface with one or more non-thumb fingers of a user and permit the user to cut, shear, scrape and/or shred an article using the index blade. The index blade 12' of the index portion 12 can be straight (as shown), serrated, linear, curved, or any suitable combination thereof for permitting efficient shearing of the article. In particular, the index portion 12 can have an index blade suited for shearing through or partially through fabrics, textiles, sheet metals, composites, organic materials, threads, ropes, clothing and the like.

The apparatus 10 of the second preferred embodiment can also include a thumb portion 16 that can have, include or define a thumb blade 16' arcuately movable in a second direction (along arrow B). As shown in the FIGURES, the second direction can be substantially opposite the arc of the first direction, such that during use the thumb portion 16 and index portion 12 move along the arcs A and B in opposing directions. The thumb portion 16 of the apparatus 10 of the second preferred embodiment can function to interface with a thumb of a user and permit the user to cut, shear, scrape and/or shred an article using the thumb blade. The thumb blade 16' of the thumb portion 16 can be serrated (as shown), straight, linear, curved, or any suitable combination thereof for permitting efficient shearing of the article. In particular, the thumb portion 16 can have a thumb blade suited for shearing through or partially through fabrics, textiles, sheet metals, composites, organic materials, threads, ropes, clothing and the like.

The apparatus 10 of the second preferred embodiment can also include a ripping portion 18 integral with the thumb portion 16. As shown in the FIGURES, the ripping portion 18 can include a ripping blade 20 manually movable in a third direction (along arrow C) substantially acute to a line parallel to the thumb blade. As shown in FIGS. 5 and 6, the ripping blade 20 is movable along direction C, the defining arrow of which intersects the line along the index/thumb blades shown in phantom at an acute angle. As used herein, the term acute angle can include any angle greater than zero degrees (i.e., substantially parallel to the line parallel to the index blade and/or thumb blade) and less than ninety degrees (i.e., substantially perpendicular to the line parallel to the index blade and/or thumb blade). In alternatives of the apparatus 10 of the second preferred embodiment, the acute angle can be approximately between twenty-five and forty-five degrees, or approximately thirty degrees. In another alternative of the apparatus 10 of the second preferred embodiment, the acute angle can be a function of the rigidity and/or material selection of the thumb portion 16 and/or the ripping portion 18.

Alternatively, the acute angle can be approximately an angle optimized for user leverage in pulling and/or ripping with the ripping blade 20.

The ripping portion 18 functions to interface with the index portion 12 and the thumb portion 16 and provide additional leverage to permit the user to rip, cut, shear, scrape and/or shred an article by pulling the apparatus 10. The ripping blade 20 can be straight (as shown), serrated, linear, curved, or any suitable combination thereof for permitting efficient ripping of the article. In particular, the ripping blade 20 can be suited for shearing through or partially through fabrics, textiles, sheet metals, composites, organic materials, threads, ropes, clothing and the like. The orientation of the ripping blade 20 can be fixed such that the direction C and the acute angle are fixed or permanent. Alternatively, the orientation of the ripping blade 20 can be variable such that the direction C and the acute angle can be changed and/or altered according to one or more predetermined parameters, including user choice, material to be ripped, ambient temperature of the material, disposition or orientation of the material relative to the user and/or any other suitable parameter or condition.

In a first variation of the apparatus 10 of the second preferred embodiment, the index portion 12 of the apparatus 10 can include an index bow defining a first opening 22 adapted to receive an index finger, and a second opening 24 adapted to receive one or more non-index fingers. The apparatus 10 of the second preferred embodiment can also include a carabiner latch configured for selective opening of the index bow. The carabiner latch of the first variation of the apparatus 10 of the second preferred embodiment can include a gate 26 that functions in cooperation with the second opening 24 to operate as a carabiner or selectively openable connector, permitting the apparatus 10 of the second variation of the first preferred embodiment to be securely and selectively fastened to a user's clothing, belt, medical bag, strap, backpack and the like. In an alternative of the apparatus 10 of the first preferred embodiment, the gate 26 can include a spring 28 so as to spring load and/or bias the gate 26 to remain in a closed position, as shown in the FIGURES, thus preventing unintended opening of the gate 26 and preventing loss or damage of the apparatus 10. In other alternatives of the apparatus 10 of the first variation of the second preferred embodiment, the gate 26 can be a wire gate, a straight gate, or a bent gate. In still other alternatives of the apparatus 10 of the first variation of the second preferred embodiment, the gate 26 can be lockable in at least one of an open or closed position, and can include a twist lock or a screw lock, which can be either automatically or manually locking depending upon the configuration thereof. To protect the end of the gate 26, the index portion 12 can be appropriately hooded or recessed (see e.g. FIG. 3).

In a second variation of the apparatus 10 of the second preferred embodiment, the apparatus 10 can include an oxygen key 32 including and/or defining an opening in the thumb portion 16 of the apparatus 10. The oxygen key 32 can function to adjust a flow from an oxygen bottle to a patient. Alternatively, the oxygen key 32 can include and/or be defined by an opening within the index portion 12 of the apparatus 10. In another alternative of the second variation of the apparatus 10 of the second preferred embodiment, the oxygen key 32 can include and/or be defined by an opening within one or both of the index portion 12 and the thumb portion 16.

In a third variation of the apparatus 10 of the second preferred embodiment, the apparatus 10 can include a glass breaker 38 composed of a hardened carbide steel projection. In one alternative of the third variation of the apparatus 10 of the second preferred embodiment, the glass breaker 38 can be a projection formed integral with or connected to the index portion 12. The glass breaker 38 can function to break various types of glass found in an emergency situation, such as automotive window or windshield glass. In another alternative of the apparatus 10 of the third variation of the second preferred embodiment, the glass breaker 38 can be affixed to the index portion 12 of the apparatus 10. The glass breaker 38 can also be varied in size and/or shape, and can be exchanged with other glass breakers (not shown) of differing density, hardness, material, size and shape by a user depending upon the type of his or her practice.

In a fourth variation of the apparatus 10 of the second preferred embodiment, the apparatus 10 can include a pin 36 selectively engageable with a detent or aperture 34 configured to substantially prohibit arcuate movement of the index portion 12 and the thumb portion 16. In an exemplary configuration of the apparatus 10 of the second preferred embodiment, the thumb portion 16 can include the pin 36 (shown in FIG. 4) or protrusion that is adapted to selectively mate with the detent 34 (shown in FIGS. 3 and 4) disposed in the index portion 12. As noted above, the pin 36 and detent 34 can be configured such that a user can selectively engage the pair by a slight lateral movement of the index portion 12 relative to the thumb portion 16. Furthermore, the pin 36 can be positioned on the thumb portion 16 such that during operation, it abuts against a top surface of the index portion 12 to prevent over-shearing of the apparatus 10 while still maintaining proper articulation and a full range of cutting motion. Conversely, the pin 36 can be disposed on the index portion 12 and the detent 34 can be disposed in/on the thumb portion 16. Other suitable locking mechanisms or means, such as selectively positionable hook-and-eye mechanisms, selectively positionable magnetic elements, and the like can be employed as an alternative to or in addition to the pin 36 and detent 34 described herein.

An apparatus 10 according to a third preferred embodiment can include an index portion 12 having an index blade 12' arcuately movable in a first direction (along arrow A) defining an arc about a pivot 14. The index portion 12 of the apparatus 10 of the third preferred embodiment can function to interface with one or more non-thumb fingers of a user and permit the user to cut, shear, scrape and/or shred an article using the index blade. The index blade 12' of the index portion 12 can be straight (as shown), serrated, linear, curved, or any suitable combination thereof for permitting efficient shearing of the article. In particular, the index portion 12 can have an index blade suited for shearing through or partially through fabrics, textiles, sheet metals, composites, organic materials, threads, ropes, clothing and the like.

The index portion 12 of the third preferred embodiment can also include an index bow defining a first opening 22 adapted to receive an index finger and a second opening 24 adapted to receive one or more non-index fingers. Separation of the first opening 22 from the second opening 24 can allow for greater cutting leverage and ergonomics. Furthermore, separation of the first and second openings 22, 24 can lessen the volume of the second opening 24, which can also function to secure the apparatus 10 of the third preferred embodiment to a belt or similar feature of a user in combination with a gate and/or as a carabiner as described herein.

The index portion 12 can further include a carabiner latch configured for selective opening of the index bow. The carabiner latch of the apparatus 10 of the third preferred embodiment can include a gate 26 that functions in cooperation with the second opening 24 to operate as a carabiner or selectively openable connector, permitting the apparatus 10 of the third preferred embodiment to be securely and selectively fastened to a user's clothing, belt, medical bag, strap, backpack and the like. In an alternative of the apparatus 10 of the third preferred embodiment, the gate 26 can include a spring 28 so as to spring load and/or bias the gate 26 to remain in a closed position, as shown in the FIGURES, thus preventing unintended opening of the gate 26 and preventing loss or damage of the apparatus 10. In other alternatives of the apparatus 10 of the third preferred embodiment, the gate 26 can be a wire gate, a straight gate, or a bent gate. In still other alternatives of the apparatus 10 of the third preferred embodiment, the gate 26 can be lockable in at least one of an open or closed position, and can include a twist lock or a screw lock, which can be either automatically or manually locking depending upon the configuration thereof.

The apparatus 10 of the third preferred embodiment can also include a thumb portion 16 connected to the index portion 12 at the pivot 14. The thumb portion 16 of the apparatus 10 of the third preferred embodiment can include a thumb blade 16' arcuately movable in a second direction (along arrow B) substantially opposite the arc of the first direction. The thumb portion 16 of the apparatus 10 of the second preferred embodiment can function to interface with a thumb of a user and permit the user to cut, shear, scrape and/or shred an article using the thumb blade 16'. The thumb blade of the thumb portion 16 can be serrated (as shown), straight, linear, curved, or any suitable combination thereof for permitting efficient shearing of the article. In particular, the thumb portion 16 can have a thumb blade suited for shearing through or partially through fabrics, textiles, sheet metals, composites, organic materials, threads, ropes, clothing and the like.

The apparatus 10 of the third preferred embodiment can also include a pin 36 selectively engageable with a detent 34 configured to substantially prohibit arcuate movement of the index portion 12 and the thumb portion 16. In an exemplary configuration of the apparatus 10 of the third preferred embodiment, the thumb portion 16 can include the pin 36 (shown in FIG. 4) or protrusion that is adapted to selectively mate with the detent 34 (shown in FIGS. 3 and 4) disposed in the index portion 12. As noted above, the pin 36 and detent 34 can be configured such that a user can selectively engage the pair by a slight lateral movement of the index portion 12 relative to the thumb portion 16. Furthermore, the pin 36 can be positioned on the thumb portion 16 such that during operation, it abuts against a top surface of the index portion 12 to prevent over-shearing of the apparatus 10 while still maintaining proper articulation and a full range of cutting motion. Conversely, the pin 36 can be disposed on the index portion 12 and the detent 34 can be disposed in/on the thumb portion 16. Other suitable locking mechanisms or means, such as selectively positionable hook-and-eye mechanisms, selectively positionable magnetic elements, and the like can be employed as an alternative to or in addition to the pin 36 and detent 34 described herein.

In a first variation of the apparatus 10 of the third preferred embodiment, the apparatus 10 can include a ripping portion 18 integral with the thumb portion 16. As shown in the FIGURES, the ripping portion 18 can include a ripping blade 20 manually movable in a third direction (along arrow C) substantially acute to a line parallel to the thumb blade. As shown in FIGS. 5 and 6, the ripping blade 20 is movable along direction C, the defining arrow of which intersects the line along the index/thumb blades shown in phantom at an acute angle. As used herein, the term acute angle can include any angle greater than zero degrees (i.e., substantially parallel to the line parallel to the index blade and/or thumb blade) and less than ninety degrees (i.e., substantially perpendicular to the line parallel to the index blade and/or thumb blade). In alternatives of the apparatus 10 of the third preferred embodiment, the acute angle can be approximately between twenty-five and forty-five degrees, or approximately thirty degrees. In another alternative of the apparatus 10 of the third preferred embodiment, the acute angle can be a function of the rigidity and/or material selection of the thumb portion 16 and/or the ripping portion 18. Alternatively, the acute angle can be approximately an angle optimized for user leverage in pulling and/or ripping with the ripping blade 20.

The ripping portion 18 functions to interface with the index portion 12 and the thumb portion 16 and provide additional leverage to permit the user to rip, cut, shear, scrape and/or shred an article by pulling the apparatus 10. The ripping blade 20 can be straight (as shown), serrated, linear, curved, or any suitable combination thereof for permitting efficient ripping of the article. In particular, the ripping blade 20 can have a thumb blade 16 suited for shearing through or partially through fabrics, textiles, sheet metals, composites, organic materials, threads, ropes, clothing and the like. The orientation of the ripping blade 20 can be fixed such that the direction C and the acute angle are fixed or permanent. Alternatively, the orientation of the ripping blade 20 can be variable such that the direction C and the acute angle can be changed and/or altered according to one or more predetermined parameters, including user choice, material to be ripped, ambient temperature of the material, disposition or orientation of the material relative to the user and/or any other suitable parameter or condition.

Pursuant to a further preferred embodiment of the shearing apparatus 10, the ripping portion 18 is a separate component, as can be best seen in FIGS. 7 to 11. In this embodiment, the ripping portion 18 is fixedly or preferably removably secured to either the index portion 12 or to the thumb portion 16, or more accurately, to the blades 12' or 16' thereof. In the illustrated embodiment, the ripping portion 18 is secured to the thumb portion 16 for reasons to be discussed subsequently.

The ripping portion 18 of this embodiment is also provided with a ripping blade 20. However, in contrast to the angle defined by the cutting edge of the ripping blade 20 of the previous embodiments, with this embodiment the cutting edge of the ripping blade 20 defines an angle toward the front and upwardly toward the thumb blade 16' of the thumb portion 16. However, the angle defined by the cutting edge of the ripping blade 20 of this embodiment could also be the same as that of the ripping blade 20 of the previously described embodiments, i.e., the cutting edge could extend at an angle toward the rear. In addition, the ripping blade 20 of this embodiment could be positioned in the main body 19 of the ripping portion 18 such that the plane of the ripping blade 20 is substantially perpendicular to the plane of the thumb blade 16' of the thumb portion 16.

Figure 9:
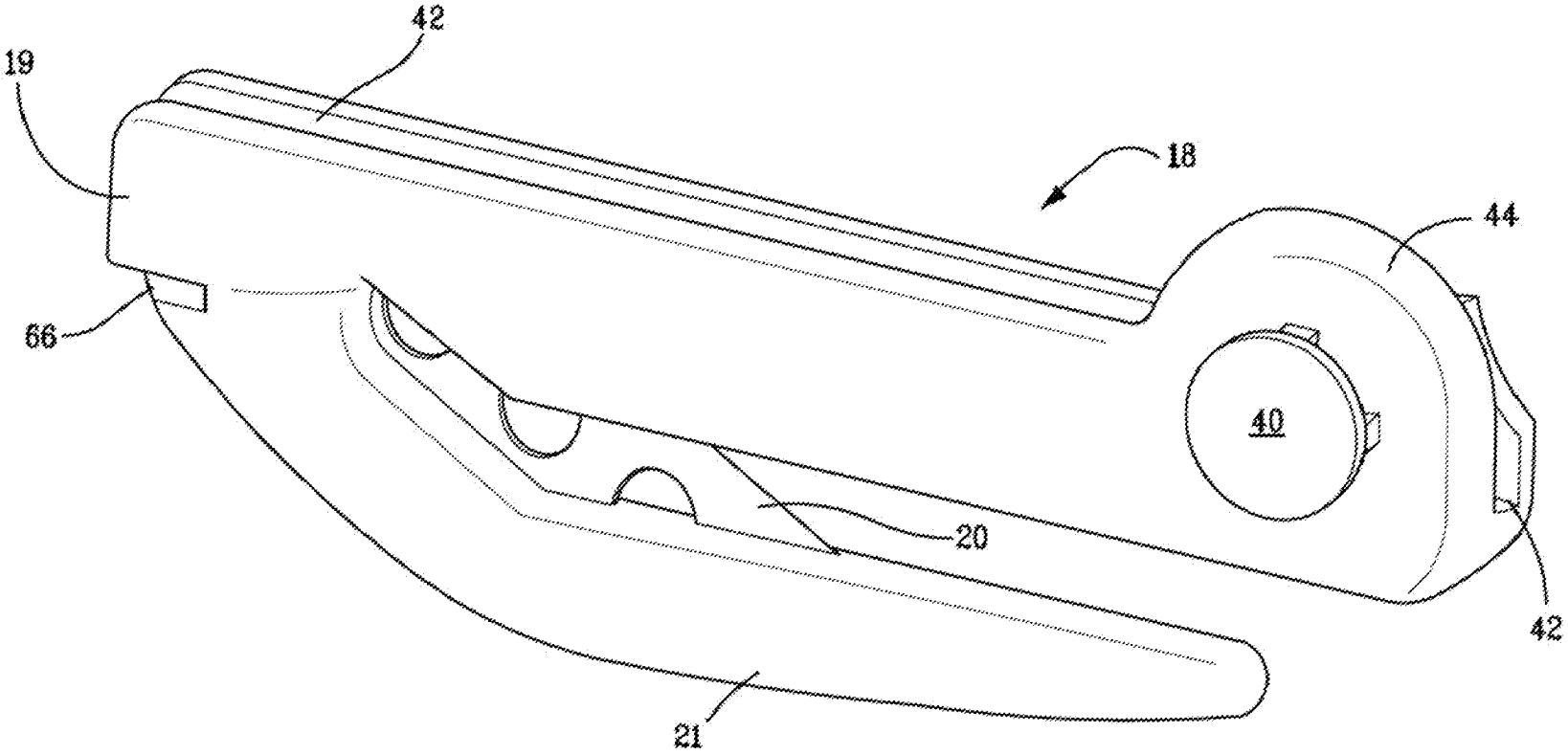
FIG. 9 is a perspective view of the ripping portion of the shearing apparatus of FIGS. 7 and 8.

Although the ripping portion 18 could be embodied to extend substantially in a plane, whereupon it would be secured to only the outer side of one of the blades 12' or 16', pursuant to a first preferred variation of the present embodiment, in order to make the securement of the ripping portion 18 to the thumb blade 16' or the index blade 12' more stable, and to facilitate removal of the ripping portion 18 from the blade, for example in order to replace a dull ripping blade 20, the ripping portion 18 can be provided with a channel 42, as best seen in FIGS. 9 to 1. In particular, the main body 19 of the ripping portion 18 is provided with the channel 42, with the latter opening out in a direction away from the leg 21 that extends below the main body 19; the ripping blade 20 is disposed in the ripping portion 18 between the main body 19 and the leg 21, with a guide opening being provided between the main body 19 and the leg 21 that is open toward the rear, i.e. where a user grasps the index portion 12 and the thumb portion 16, wherein the guide portion provides access to the ripping blade 20.

To install the ripping portion 18, for example on the thumb portion 16, the main body 19 is placed below the thumb blade 16' and the channel 42 is moved upwardly and over the bottom edge of the thumb blade 16'. The thumb portion 16 is preferred for carrying the ripping portion 18 since the cutting edge of the index blade 12' does not extend as far down as does the cutting edge of the thumb blade 16', allowing space for the pertaining side of the main body 19 (see, for example, FIG. 8).

As indicated above, the separate ripping portion 18 of this embodiment is fixedly or preferably removably secured to one of the blades, such as the thumb blade 16'. Pursuant to a second preferred variation of this embodiment of the shearing apparatus 10, the connection of the ripping portion 18 to the thumb blade 16' of the thumb portion 16 is effected by means of a pin 40. In the illustrated embodiment, the pin 40 is disposed at that end of the ripping portion 18 that, in the installed position, is closer to the pivot or pivot mechanism 14 about which the index portion 12 and the thumb portion 16 are pivotable. However, it is to be understood that the pin 40 could also be disposed in the vicinity of the opposite end of the ripping portion 18.

Figure 10:
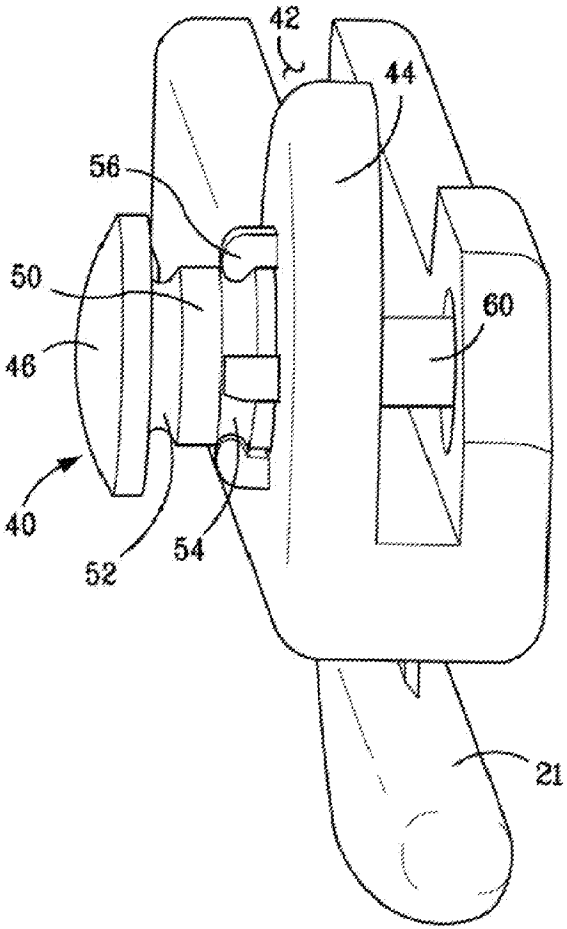
FIG. 10 shows the ripping portion of FIG. 9 in the open position of the pin thereof.
Figure 11:
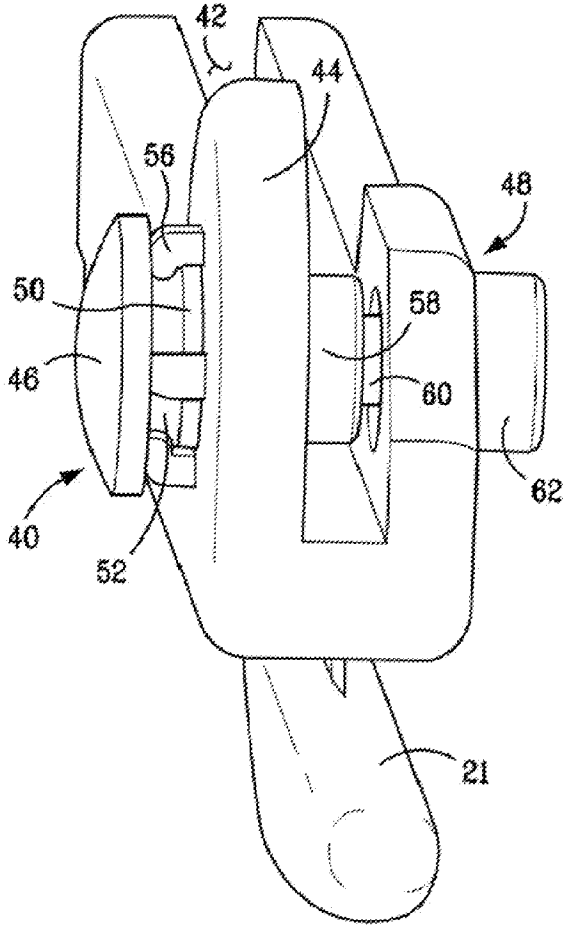
FIG. 11 shows the ripping portion of FIG. 9 in the closed position of the pin thereof.

As can best be seen in the open position of the pin 40 illustrated in FIG. 10, the pin is actually displaceably mounted on the ripping portion 18, and in particular on the enlarged portion 44 thereof. The pin 40 has a profiled shaft 48, as can be fully appreciated from both the open and closed positions shown in FIGS. 10 and 11 respectively. At that end adjacent to the head 46, the profiled shaft 48 is provided with an enlarged-diameter portion 50 in which are provided two grooves 52 and 54 for a purpose to be discussed in detail subsequently. As can also be seen from FIGS. 10 and 11, detents 56 disposed on the enlarged portion 44 of the ripping portion 18 serve to engage one or the other of the grooves 52 and 54, thus retaining the pin 40 on the ripping portion 18. Successively disposed adjacent to the enlarged-diameter portion 50 of the shaft 48 are a middle portion 58 (see FIG. 11) that is of the same or smaller diameter than is the enlarged portion 50, followed by a reduced diameter portion 60 and another enlarged-diameter portion 62. During installation of the ripping portion 18 upon, for example, the thumb blade 16' of the thumb portion 16, the pin 40 is in the open position shown in FIG. 10, so that when the channel 42 is placed over the lower edge of the thumb blade 16', the reduced-diameter portion 60 of the pin shaft 48 can pass into the notch 64 provided in the lower edge of the thumb blade 16' (see FIG. 14). Alternatively, if a bore is provided in the thumb blade 16' in place of the notch 64, the pin 40 would have to be pulled nearly entirely out of the enlarged portion 44 of the ripping portion 18. In this variation, an additional groove could be provided in the last enlarged-diameter portion 62 of the pin shaft 48 in order to retain the pin, via the detents 56, in the enlarged portion 44 of the ripping portion 18 to prevent separation and loss of the pin 40.

After the ripping portion 18 has been placed upon the thumb blade 16', with the reduced-diameter portion 60 nested in the notch 64 of the thumb blade 16', the pin 40 can be pushed further into the enlarged portion 44 and hence further through the thumb blade 16'. In so doing, the larger-diameter middle portion 58 of the pin shaft 48 will come to rest snugly in the corresponding contours or diameter of the notch 64 in the thumb blade 16', and the pin 40 will be held in this position due to the engagement of the detents 56 in the groove 52 that is adjacent to the head 46 of the pin 40. To further secure the ripping portion 18 in position on the thumb blade 16', a tab 17' (FIG. 7) is provided at the distal end of the thumb blade 16'. During installation, a slot or notch 66 (FIG. 9) provided in the ripping portion 18 where the leg 21 and the main body 19 meet would first be placed over the tab 17' prior to placing the channel 42 over the lower edge of the thumb blade 16'.

Figure 4:
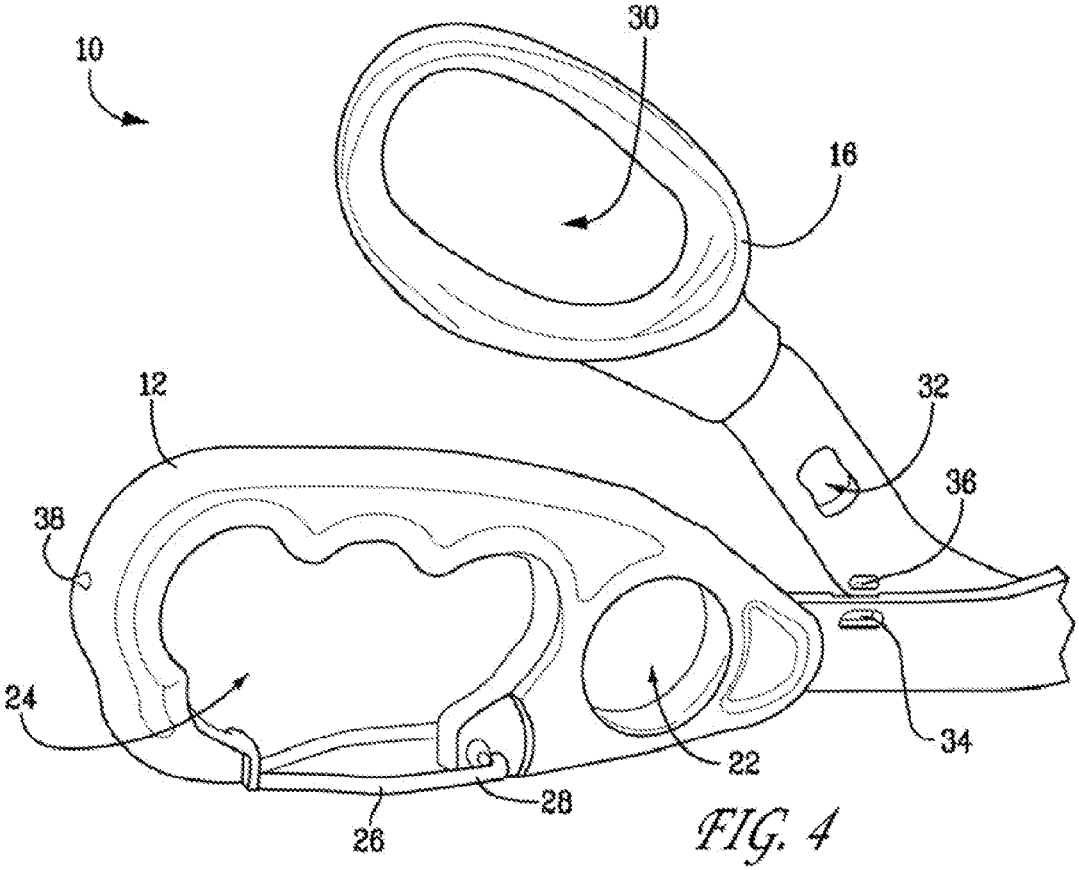
FIG. 4 is a perspective view of a first portion of a shearing apparatus in accordance with one or more preferred embodiments of the present invention.
Figure 13:
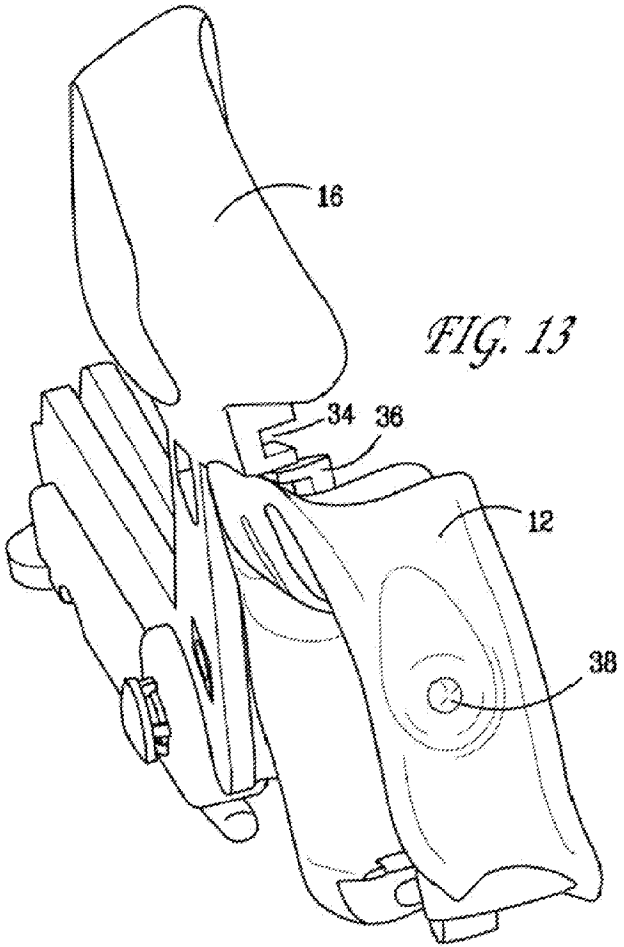
FIG. 13 is a perspective view showing further aspects of a shearing apparatus in accordance with one or more preferred embodiments of the present invention.
Figure 12:
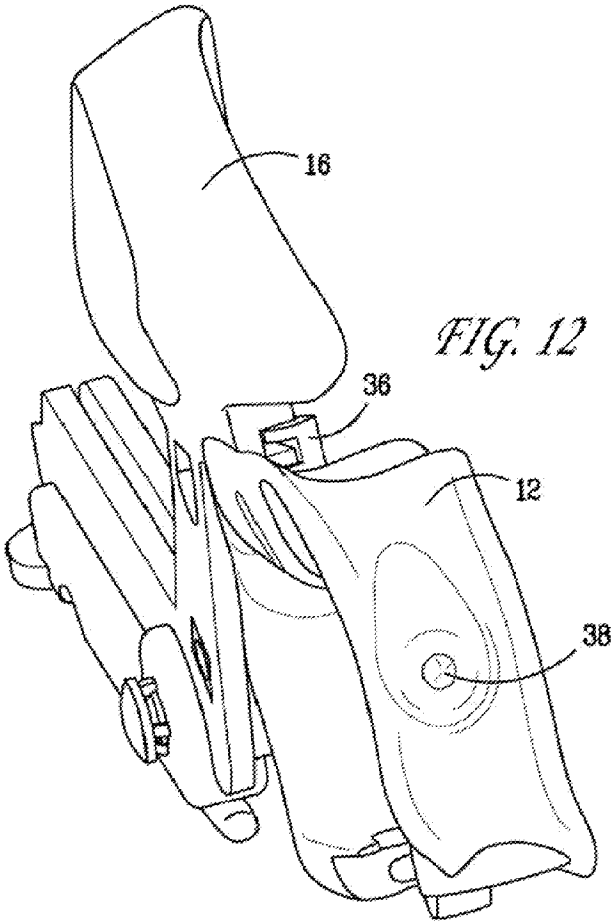
FIG. 12 is a perspective view showing further aspects of a shearing apparatus in accordance with one or more preferred embodiments of the present invention.

In the embodiment of, for example, FIG. 4, the locking mechanism for locking the index portion 12 and the thumb portion 16 together in a closed position is shown as a cooperating pin 36 and recess 34. FIGS. 12 and 13 show an alternative locking mechanism. In this variation, a latch or detent 36 on one of the index portion 12 or the thumb portion 16 is adapted to engage in a recess 34 in the other of the thumb portion 16 or index portion 12. It should be further noted that in the illustrated embodiments, the positions shown for the various locking mechanisms are for illustrative purposes only. It is to be understood that the locking mechanism can be disposed in any convenient position.

Figure 8:
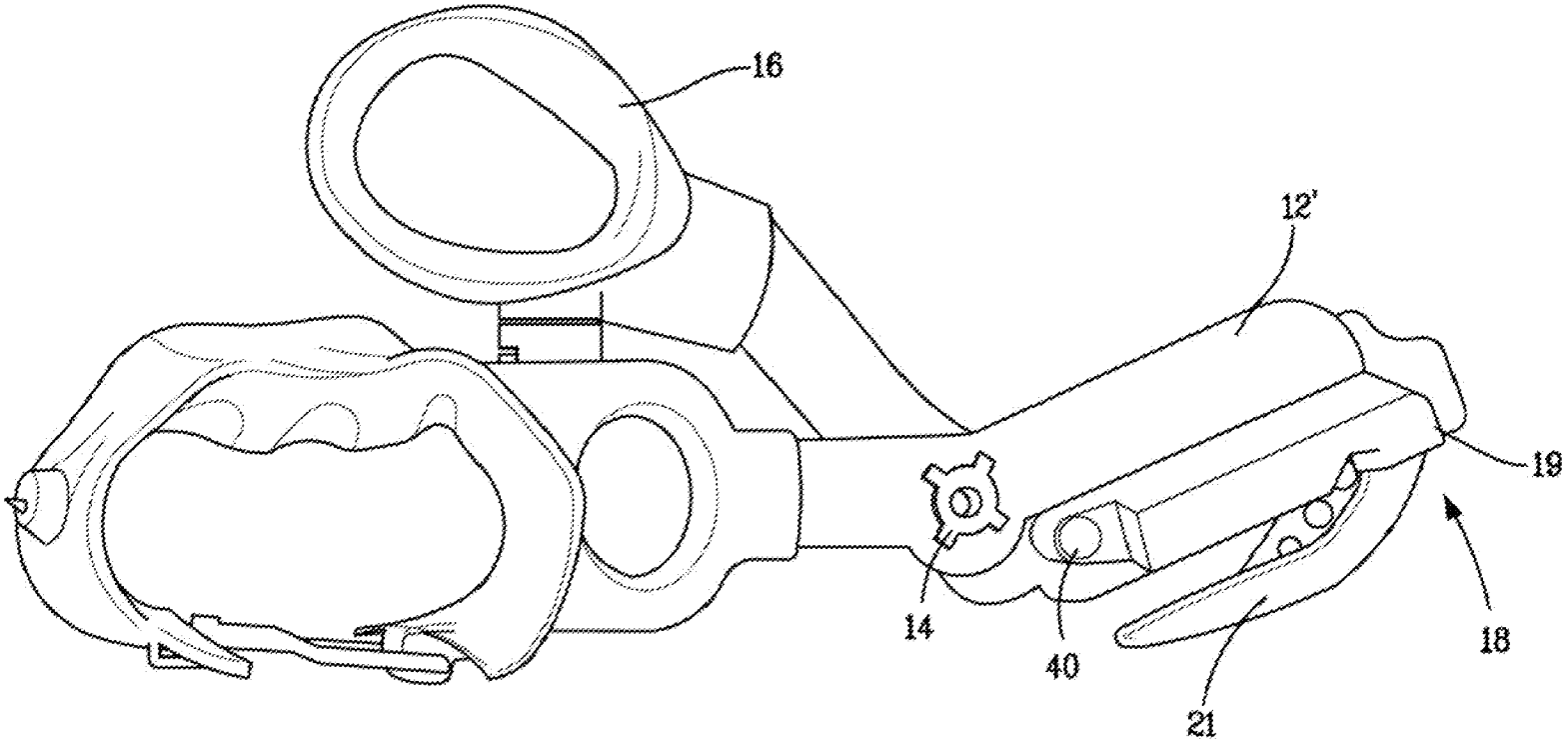
FIG. 8 is a perspective view of the shearing apparatus of FIG. 7 as seen from the opposite side.
Figure 14:
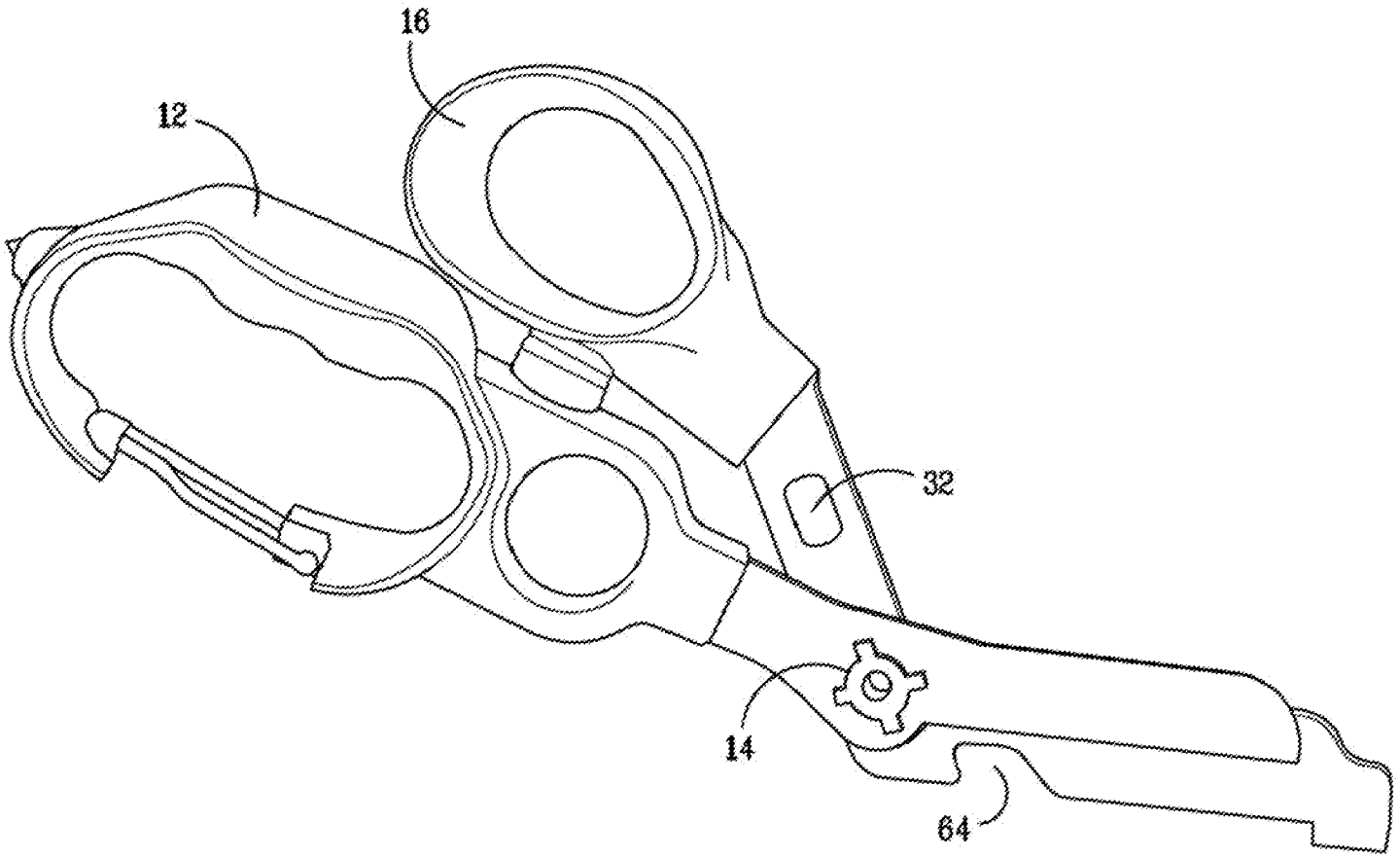
FIG. 14 is a perspective view showing further aspects of a shearing apparatus in accordance with one or more preferred embodiments of the present invention.

As an alternative to the pivots or pivot mechanisms 14 discussed in conjunction with the previously described embodiments, as shown by way of example in FIGS. 8 and 14 the pivot or pivot mechanism 14 can also be in the form of a key lock, so that by a simple partial rotation, the pivot mechanism 14 can be engaged or disengaged, allowing for a quick and easy assembly or disassembly of the index portion 12 and the thumb portion 16 to facilitate replacement or sharpening of one or both of the blades 12' and 16'.

The index blade 12' and the thumb blade 16' of the index portion 12 and the thumb portion 16 respectively are preferably hollow ground blades, i.e. are provided with a concavity, as is known by one of skill in the shearing art. In addition, the blades, especially the thumb blade 16', expediently have a greater than standard width.

Figure 7:
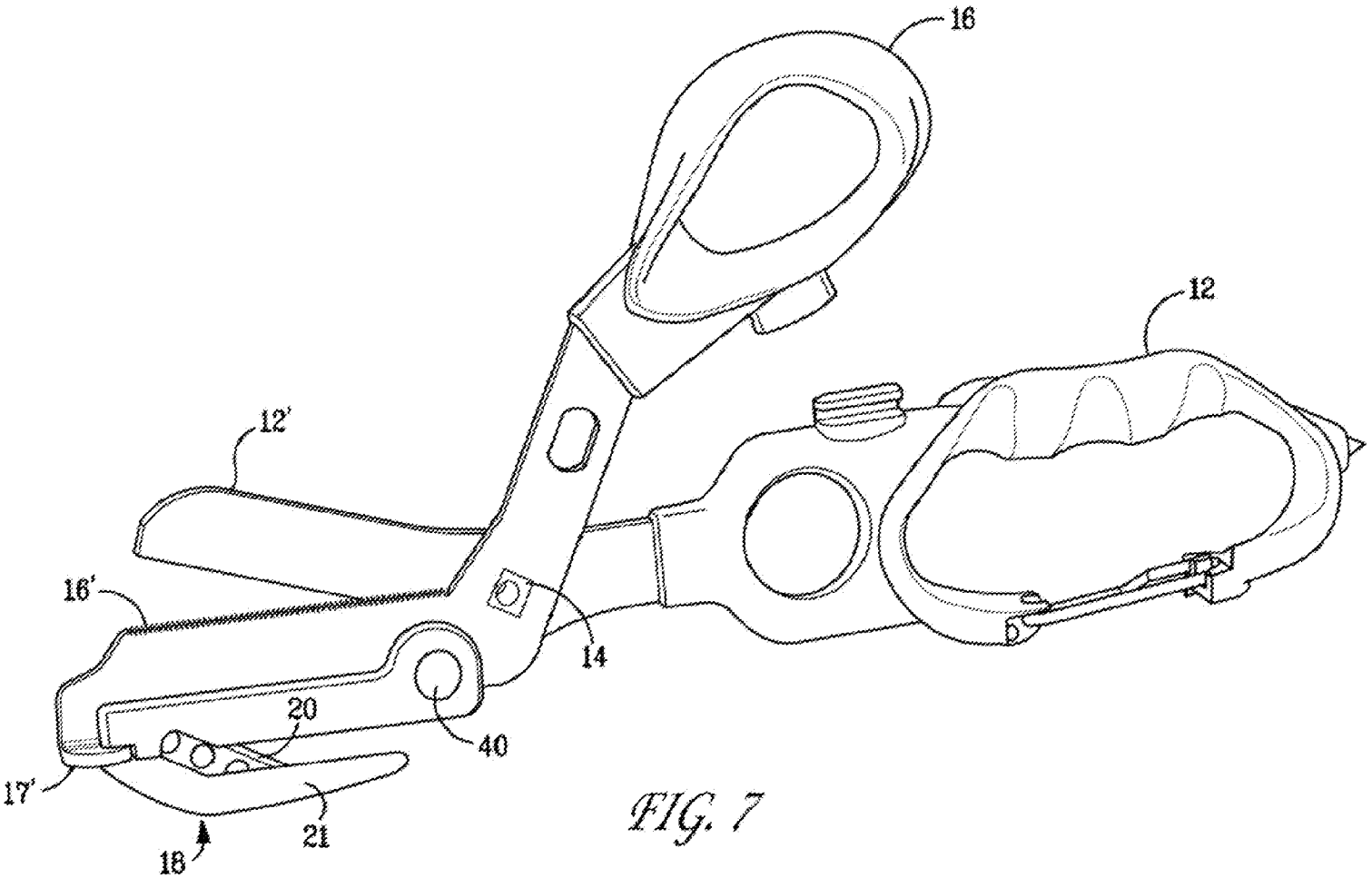
FIG. 7 is a perspective view of a shearing apparatus in accordance with one or more preferred embodiments of the present invention.

As can be seen, for example, from FIGS. 7 to 9, the ripping blade 20 of the ripping portion 18 can be provided with one or more holes. These holes allow an appropriate tool to more easily handle the ripping blade 20 for installation in, or removal from, the ripping portion 18.

The terminology used herein is for the purpose of describing particular embodiments only and is not intended to be limiting of the invention. As used herein, the singular terms "a", "an" and "the" are intended to include the plural forms as well, unless the context clearly indicates otherwise. It will be further understood that the terms "comprises" and/or "comprising," when used in this specification, specify the presence of the stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements and specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The preferred embodiments were chosen and described in order to best explain the principles of the invention and the practical applications, and to enable others of ordinary skill in the art to understand the invention for various embodiments with various modifications as are suited to the particular use contemplated.

The present invention is, of course, in no way restricted to the specific disclosure of the specification and drawings, but also encompasses any modifications within the scope of the appended claims.

The invention claimed is:

1. A shearing apparatus comprising:

an index portion (12) having a finger hole and an index blade (12') accurately movable in a first direction (A) defining an arc about a pivot (14), wherein the finger hole and the index blade are disposed on opposite sides of the pivot;

a thumb portion (16) pivotably connected to the index portion (12) at the pivot (14), the thumb portion (16) having a thumb hole and a thumb blade (16') accurately movable in a second direction (B), wherein the second direction is substantially opposite the arc of the first direction, and wherein the thumb hole and the thumb blade are disposed on opposite sides of the pivot; and a ripping portion (18) disposed on and movable with one of the thumb blade (16') or the index blade (12'), wherein the ripping portion (18) is a separate component that is secured to the thumb blade (16') or the index blade (12'), further wherein the ripping portion (18) includes a main portion (19) secured to the index blade (12') or the thumb blade (16'), and a leg (21) that extends away from the main portion (19), further wherein the main portion (19) of the ripping portion (18) is provided with a channel (42) for placement over a lower edge of the thumb blade (16') or the index blade (12'), further wherein the ripping portion (18) has a ripping blade (20) manually movable in a third direction (C) at an angle, parallel or perpendicular to a line (L) parallel to at least one of the index blade (12') and the thumb blade (16'), further wherein the ripping blade (20) is disposed between the main portion (19) and the leg (21), further wherein the index blade or the thumb blade includes a tab portion (17) being inserted in a recess (66) of the ripping portion (18), the tab (17) extends substantially perpendicular to the first direction (A), the second direction (B) and the third direction (C) of the index portion (12), the thumb portion (16) and the ripping blade (20) respectively, and wherein the ripping portion (18) is disposed at an end of the index blade (12') or the thumb blade (16') that is remote from the finger hole or the thumb hole on a side of the pivot opposite the finger hold or the thumb hole.

2. A shearing apparatus according to claim 1, wherein the ripping portion (18) is fixedly or removably secured to the thumb blade (16') or the index blade (12') via a pin (40).

3. A shearing apparatus according to claim 1, wherein the pin (40) has a profiled shaft (48) including two grooves (52, 54), further wherein the ripping portion (18) is provided with detents (56) for selectively engaging one of the grooves (52, 54) in the pin shaft (48) for retaining the ripping portion (18) in an open position for placement upon or removal from the thumb blade (16) or the index blade (12'), or for securement of the ripping portion (18) upon the thumb blade (16') or the index blade (12').

4. A shearing apparatus according to claim 1, wherein the ripping blade (20) is manually movable in the third direction (C) substantially parallel or perpendicular to the line (L) parallel to at least one of the index blade (12') and the thumb blade (16').

5. A shearing apparatus according to claim 1, wherein the ripping blade (20) is manually movable in the third direction (C) at a substantially acute angle to the line (L) parallel to at least one of the index blade (12') and the thumb blade (16').

6. A shearing apparatus according to claim 1, wherein a guide opening is provided between the main portion (19) and the leg (21) of the ripping portion (18), and wherein the guide opening is open in a direction toward the finger hole or the thumb hole.

7. A shearing apparatus according to claim 1, wherein a cutting edge of the ripping blade (20) extends in a direction toward or away from the finger hole or the thumb hole.

8. A shearing apparatus according to claim 1, wherein the third direction (C) of the ripping blade (20) extends at an angle of between approximately 25 and 45 degrees to the line (L) parallel to at least one of the index blade (12') and the thumb blade (16').

9. A shearing apparatus according to claim 8, wherein said angle is variable or fixed.

10. A shearing apparatus according to claim 8, wherein said angle is approximately 30°.

11. A shearing apparatus according to claim 1, wherein the pivot (14) is a key lock type pivot mechanism or an adjustable connector.

12. A shearing apparatus according to claim 1, wherein the finger hole of the index portion (12) includes a gate (26) that is in the form of a selectively openable connector.

13. A shearing apparatus according to claim 1, which includes an oxygen key or wrench (32) provided on the index portion (12) or the thumb portion (16).

14. A shearing apparatus according to claim 1, which includes a glass breaker (38) in the form of a projection on the index portion (12) or the thumb portion (16).

* * * * *